United States Patent [19]

Jorgensen et al.

[11] Patent Number: 4,771,578

[45] Date of Patent: Sep. 20, 1988

[54] APPARATUS FOR THE GRINDING OR POLISHING OF WORKPIECES

[75] Inventors: Gert Jørgensen; Klaus Kisbøll, both of Lyngby, Denmark

[73] Assignee: Struers A/S, Rodovre, Denmark

[21] Appl. No.: 40,535

[22] Filed: Apr. 17, 1987

[30] Foreign Application Priority Data

Apr. 18, 1986 [DK] Denmark ..... 1805/86

[51] Int. Cl.[4] ..... B24B 49/02

[52] U.S. Cl. ..... 51/165.77; 51/118; 51/129

[58] Field of Search ..... 51/165.77, 165.92, 165 R, 51/129, 118

[56] References Cited

U.S. PATENT DOCUMENTS 3,100,954 8/1963 Di Lella ..... 51/165.77
3,224,148 12/1965 Mitchell ..... 51/129
3,702,043 11/1972 Welbourn ..... 51/165.77
4,370,835 2/1983 von Schneidemesser ..... 51/165.92
4,545,153 10/1985 Miller ..... 51/118

*Primary Examiner*—Robert P. Olszewski
*Attorney, Agent, or Firm*—Watson, Cole, Grindle & Watson

[57] ABSTRACT

In an apparatus for the grinding or polishing of workpieces, particularly metallographic samples, the grinding or polishing pressure is transmitted to the workpiece through a deformable transmission link which is strained by strain gauges of an activating member, which is then immobilized. The apparatus comprises means for sensing the elastic deformation of the transmission link and changes of that deformation during the progress of the process, whereby a simultaneous measurement of the grinding or polishing pressure and the depth of the layer of material removed by the grinding or polishing is obtained.

4 Claims, 1 Drawing Sheet

APPARATUS FOR THE GRINDING OR POLISHING OF WORKPIECES

BACKGROUND OF THE INVENTION

The invention relates to an apparatus for the grinding or polishing of workpieces, particularly metallographic samples, in which the workpiece is pressed against a grinding or polishing disc under the influence of an operative force which is transmitted to the workpiece, and is thereby subjected to an operative pressure, i.e., grinding or polishing pressure equal to the operative force divided by the surface area of the workpiece being ground or polished.

When such an apparatus is used for grinding (including honing) or polishing, an abrasion takes place, i.e., material is removed from the surface of the sample in contact with the grinding or polishing disc.

It is usually the intention, particularly within the metallographic field, to obtain removal of a surface layer of a predetermined thickness, or in other words to obtain a predetermined abrasion depth, or at any rate an abrasion depth within a predetermined order of size.

To achieve this, it has hitherto been customary to use the process time as a parameter, meaning that the grinding or polishing is terminated after the lapse of a certain processing time which has been established empirically. This method, however, involves considerable uncertainty, seeing that, e.g., a variation of the abrasive properties of a grinding stone will result in an abrasion depth per time unit different from that on which the establishment of the processing time was based.

It will therefore be advantageous to be able to perform a direct measurement of the abrasion depth. Such a measurement could be obtained by means of an optic measuring system similar to the systems which are used on modern machine tools for measuring distances within the $\mu$m range. While such systems are very accurate, they are much too expensive for use in connection with ordinary metallographic grinding and polishing, and they would not provide any indication of the grinding or polishing pressure. This pressure, which is also an important parameter of the process, would therefore have to be measured separately.

SUMMARY OF THE INVENTION

It is the object of the invention to provide an apparatus of the kind referred to in which the grinding or polishing pressure and the abrasion depth can be measured jointly at very low expenditure for measuring equipment.

To achieve this, the features characterizing the invention are that in a power transmission path for the operative force there is provided an elastically deformable transmission link, and that, at the end of the power transmission path remote from the workpiece, there is provided an activating member which is adapted, at the commencement of the grinding or polishing, to strain the elastically deformable link until a desired value of the operative force or pressure has been obtained, and then to be immobilized during the progress of the process, the apparatus further comprising means for sensing the elastic deformation of the transmission link and changes of that deformation occurring during the progress of the process, and for determining both the operative force or pressure and the abrasion depth from the values established by the sensing.

Since, in the apparatus according to the invention, the operative force is transmitted from a point in a locked position through the elastically deformable transmission link, the operative force will gradually drop during grinding, as the abrasion proceeds (which is as a rule advantageous), and the difference between the operative force or pressure at a given moment and the value of the operative force or pressure at the commencement of the grinding or polishing will therefore constitute a measure of the abrasion depth. Therefore, the instantaneous value of the elastic deformation of the transmission link will at any stage of the process provide a signal representative of both the operative force and the abrasion depth. The elastic deformation of a body can, as is well known, be measured by means of simple and inexpensive transducers, such as strain-gauges or capacitive transducers, and by means of simple electronic equipment the measuring results may be processed and utilized for reading and/or process control.

The electronic equipment may comprise a microprocessor into which parameters for controlling the process in accordance with a desired program may be read.

If it is, e.g., desired, at a given point of the process, to reduce the operative force or pressure beyond the reduction which occurs automatically, the microprocessor may be programmed to re-set the activating member in such a manner that the desired reduction of the operative force or pressure is obtained, to store the value of the abrasion depth which was measured immediately before the re-setting, and after the re-setting to count the abrasion depth further up from the stored value in accordance with the reduced value of the operative force.

Another possibility, which will often be advantageous, is to read in the desired abrasion depth as a control parameter for the process, in such a manner that the process is terminated when the desired abrasion depth has been reached. In this connection it may occur, when using a grinding stone, that this, after having been initially dressed, does not keep its abrasive properties long enough to achieve the desired abrasion depth within a predetermined maximum of time. The electronic automatic system may in that case be programmed to interrupt the grinding operation, to initiate a dressing and thereafter to continue the grinding process. In this case, too, the value of the abrasion depth is stored during the temporary interruption, and the counting is continued from this point when the process is continued.

The apparatus may in known manner be provided with a rotating sample holder, by means of which the workpiece is caused, during the process, to perform a circular motion about an axis eccentric to that of the grinding or polishing disc.

Seeing that a mechanical machine cannot be built without certain tolerances, and neither the sample holder nor the grinding/polishing disc can rotate without a certain dissymmetry, an improvement of the measurement can be obtained by establishing an average value of the starting position from which the abrasion depth is calculated. During the progress of the process, an averaging likewise takes place for use in calculating the abrasion depth. The averaging may take place over a single revolution or a number of revolutions of the sample holder, depending on the abrasive element (grinding/polishing disc) being used. The period of averaging may be established purely electronically or by means of an angle indication signal from a revolving part.

DESCRIPTION OF THE PREFERRED EMBODIMENT

Figures 1, 2:
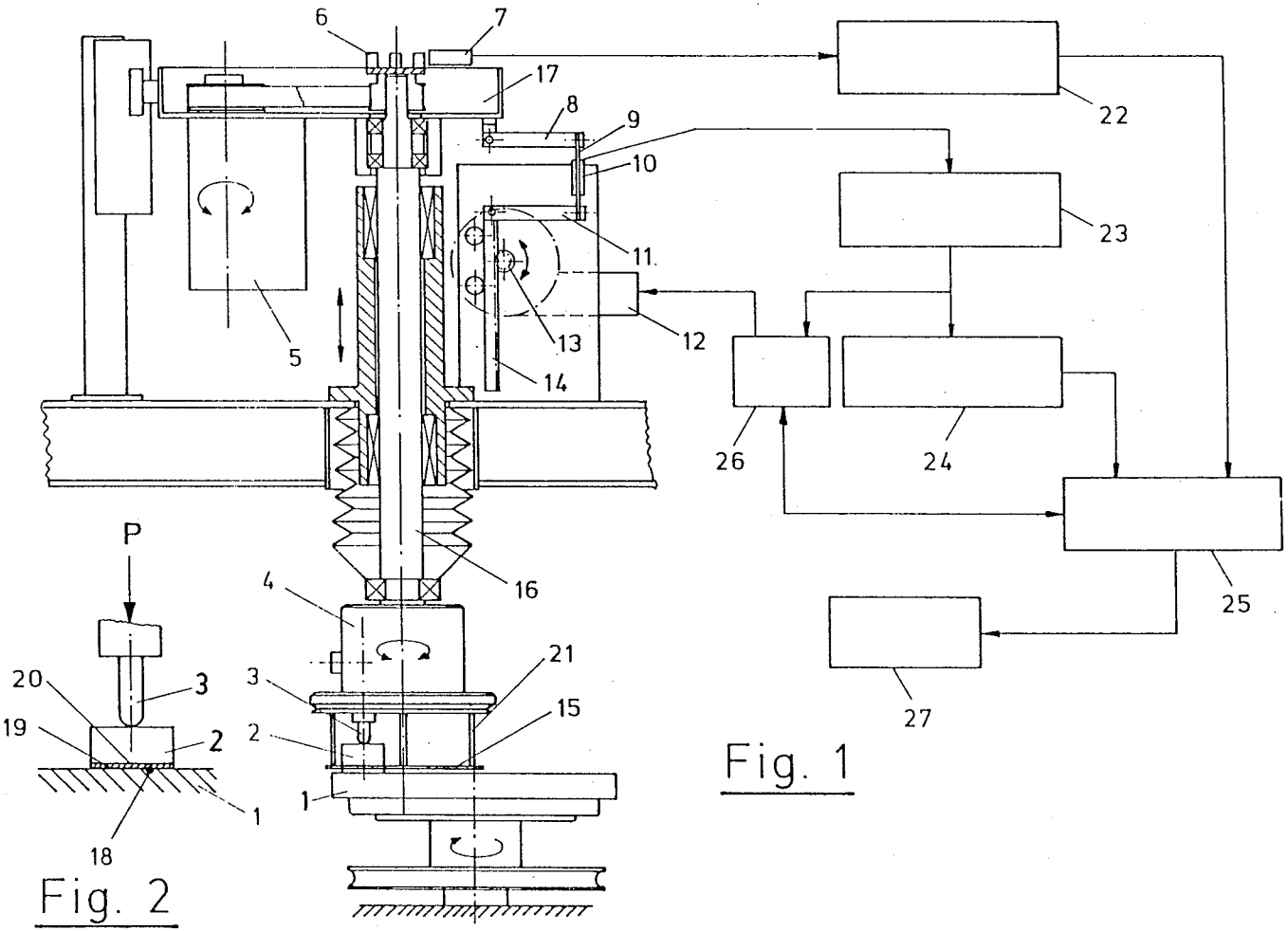
FIG. 1 diagrammatically shows an embodiment of an apparatus according to the invention, the mechanical parts being viewed from the side and partly in diametrical section.
FIG. 2 shows a detail of the apparatus on an enlarged scale.

A metallographic sample 2 is placed on a grinding-/polishing disc 1 rotatably mounted in the frame of the apparatus, and is engaged by a pressing shoe 3, see also FIG. 2, at a power P which is transferred from a rotating shaft 16.

The sample is guided by a driving plate 15, which has at least one hole for receiving a sample, and through four stays 21 is fixedly connected with a sample holding head 4, which rotates together with the shaft 16. The rotation is effected by means of an electric motor 5.

The shaft 16 can also be vertically moved, which must take place for placing the sample 2 on the driving plate 15, and for transmitting the required force P. This vertical movement is effected by means of a gear motor 12, which through a pinion 13 operates an activating member in the form of a rack 14. The gear motor 12 is fixedly anchored to the frame of the machine. When a downward movement of the sample holding head 4 is desired, the gear motor 12 is started, and the rack 14 is moved downwards. This movement is transferred to a bar 11 through a hinged connection 11*a*. The bar 11 is connected with a bar 8 through a resilient bar 9. Two strain-gauges (half bridges) 10 are mounted on the bar 9. The bar 8 is hingedly connected at 8*a* with a bracket 17 acting on the shaft 16. Thus, when the shaft 16 is urged downwards by the bracket 17 to press the sample 2 against the grinding or polishing disc 1, the resilient bar 9 is subjected at each end to a torque equal to the force transmitted from the rack 14 to the bracket 17 multiplied by the effective length of each of the bars 11, 8, and is thereby bent, and the amount of bending is sensed by the strain-gauges 10.

The gear motor 12 is self-locking, and when it is stopped, the rack 14 is therefore immobilized in the position to which it has been moved.

By means of an inductive sensor 7 and a rotating toothed disc 6 the angular movement of the shaft 16, and thereby of the sample holding head 4 can be read.

The gear motor 12, the strain-gauges 10 and the sensor 7 are connected to an electronic control comprising a comparator with Schmitt-trigger 22, a differential amplifier 23, an analog/digital converter 24, a microprocessor 25, a pressure control unit 26 and a display 27 for reading the pressure and the abrasion depth.

At the beginning of the process, the surface of the sample is at 18, but as the process progresses, material is removed, as indicated by the hatched area 19, and when the process is finished, a new surface 20 has been formed.

When it is desired to remove a predetermined number of μm indicated by the reference character 19, this is carried out as follows, cf. FIG. 1:

The sample 2, after having been placed in the driving plate 15 connected with the sample holding head 4, is moved by the gear motor 12 towards the rotating grinding or polishing disc 1.

When the desired pressure has been obtained, the current to the gear motor 12 is interrupted, whereby the rack 14 is immobilized. Thereafter the microprocessor waits for a signal from the inductive position sensor 7. When the signal arrives, the A/D-converter is started, and the voltage from the strain-gauge differential amplifier, which has now become an expression of the vertical position of the sample 2, is read by the microprocessor. While the sample holding head 4 continues to rotate, new values are read in, and when the sample holding head has rotated precisely 360°, which is read by the position sensor 7, the average value is calculated. This value is now an expression of the initial vertical position of the sample. Now, one averaging after the other is executed, and when the difference between the averaging calculation last performed and that representing the initial position is equal to the specified abrasion depth, the grinding/polishing process is stopped.

The reason why the values measured should be used only after an averaging over 360° is that owing to the mechanical tolerances the vertical position of the sample becomes a function of its horizontal position.

Moreover, the measuring principle depends on whether a grinding stone or a polishing disc is being used. In the case of the grinding stone, it suffices to average over 360°, because the stone has been dressed in the same apparatus so that the vertical position of the sample is independent of the rotation of the grinding stone. In the case of a polishing disc, no such dressing takes place, and the position of the sample will therefore depend not only on the rotation of the sample holding head, but also on the rotation of the polishing disc. The averaging must therefore be performed over a much larger number of revolutions of the sample holding head, so that the contribution from the polishing disc itself is included in the averaging function.

As will be seen from the above explanation, a concordance exists between the abrasion rate and the averaging period, seeing that the calculation of the initial position must necessarily be completed quickly in the case of a grinding disc having a high abrasion rate, while a somewhat longer time is permissible in the case of a polishing disc having a lower abrasion rate.

For further elucidating the process, some examples of numerical values will be given below:

The pressure per sample may vary from 50–60N in the case of grinding or rough polishing to 3N in the case of fine polishing.

During the process, when the bar 11 is immobilized, the pressure will drop gradually as material is removed from the sample 19. This drop of pressure is not great, but in principle it has a beneficial influence since a drop of pressure towards the end of the process is often desirable.

The drop of pressure depends on the coefficient of resiliency of the resilient bar 9. In a typical case, the drop of pressure may amount to 3N per 0.1 mm downward movement of the sample 2. For a depth 19 of removal of material amounting to 0.2 mm this will result in a pressure reduction of 12% at a final pressure of 50N.

The quantity of material removed from the sample will normally be of the order of 0.1 to 0.5 mm. The abrasion depth will be determined within a tolerance of ±5 μm, to ±10 μm depending on the mechanical and electronic construction of the machine.

What is claimed is:

1. An apparatus for the grinding of a workpiece, said apparatus comprising a frame, a grinding or polishing disc rotatably mounted in said frame, an activating member, means forming a path for the transmission of an operative force from said activating member to a workpiece in contact with said disc thereby to urge the workpiece against said disc at an operative pressure, said path including an elastically deformable transmission link, means for moving said activating member so as to strain or relieve said elastically deformable link and for immobilizing said activating member relative to said frame at an initial value of said operative force at the commencement of a grinding or polishing operation and keeping it thus immobilized during the progress of the operation, means for sensing the elastic deformation of said transmission link to produce a sensing signal, and means for measuring both the initial value of the sensing signal at the commencement of the grinding or polishing operation, the current value of the sensing signal during progress of the grinding or polishing operation, and the difference between said initial value and said current value, said difference constituting a measure of the abrasion depth.

2. An apparatus as in claim 1, further comprising rotatable guiding means for causing a workpiece in contact with said grinding or polishing disc to perform a circular motion about an axis eccentric to that of said grinding or polishing disc, and means for averaging the measuring results of said measuring means over at least one revolution of said guiding means.

3. An apparatus as in claim 1, in which said measuring means comprise a microprocessor into which parameters for controlling the abrasive process in accordance with a desired program can be encoded.

4. An apparatus as in claim 2, in which said measuring means comprise a microprocessor into which parameters for controlling the abrasive process in accordance with a desired program can be encoded.

* * * * *